US005655918A

United States Patent [19]

Soh

[11] Patent Number: 5,655,918

[45] Date of Patent: Aug. 12, 1997

[54] SELECTABLE EJECTOR FOR A DOUBLE-DECK PCMCIA EJECT HEADER

[75] Inventor: Lip-Teck Soh, Singapore, Singapore

[73] Assignee: Berg Technology, Inc., Reno, Nev.

[21] Appl. No.: 607,969

[22] Filed: Feb. 29, 1996

[51] Int. Cl.[6] ..... H01R 13/62

[52] U.S. Cl. ..... 439/159; 439/541.5

[58] Field of Search ..... 439/152–160, 439/541.5

[56] References Cited

U.S. PATENT DOCUMENTS 5,197,894 3/1993 Koike ..... 439/159

5,364,275 11/1994 Ota et al. ..... 439/541.5

*Primary Examiner*—Neil Abrams

*Assistant Examiner*—Brian J. Biggi

*Attorney, Agent, or Firm*—Bruce J. Bowman; Daniel J. Long; M. Richard Page

[57] ABSTRACT

An ejection mechanism for an electrical connector, especially a double-deck PCMCIA card header/electrical connector, has a single card eject selection button and associated ejection shaft that is manually positionable to selectively engage and actuate upper or lower card ejectors through respective upper or lower ejector push-rods. The user manually positions the selection button so as to only eject one of the upper or lower cards. Upon actuation of the selection button and subsequent ejection of the desired card from the selected upper or lower connector slot, the selection button returns to a pre-selection or initial position. The selection button includes a safety mechanism that prevents accidental ejection of the nonselected card.

16 Claims, 3 Drawing Sheets

SELECTABLE EJECTOR FOR A DOUBLE-DECK PCMCIA EJECT HEADER

FIELD OF THE INVENTION

The present invention relates to electrical connectors especially of the type having an ejection mechanism for releasing a mating device from engagement therewith and, more particularly, to an electrical connector for IC cards having an improved ejection mechanism.

BACKGROUND OF THE INVENTION

In the evolution of electrical components, especially computer related electrical components, electrical connectors have become extremely specific to various applications and hardware peripherals. While most connectors require manual mating and release, some connectors are equipped with mechanical release mechanisms. These release mechanisms facilitate the removal of the mating device or connector and are useful in situations where the mating device or connector is repeatedly inserted and removed. Generally, the type of connectors that are equipped with such release mechanisms are those which temporarily couple a device such as a diskette or an IC card, one type of which is known as a PCMCIA (Personal Computer Memory Card International Association) card, to the computer in order to store or receive data contained on the particular diskette or IC card. The diskette or IC card may be one type of a mating device that must be electrically coupled to the computer via the connector. The PCMCIA card usually contains one type of program or data and thus must be removed from the connector before another PCMCIA card is inserted therein.

Receiving connectors for PCMCIA type cards have a plurality of extending, electrically conductive contacts or terminals that are adapted to be received in and be electrically coupled to mating contacts/sockets on or in the mating PCMCIA card. The PCMCIA cards are generally a plastic encased, populated circuit board of LSI-type chip. The case has a plurality of corresponding sockets that function in one respect to receive the contacts of the connector and allow electrical coupling with the internal circuit. The connector is generally a frame having side slots to guide the PCMCIA card therein. This facilitates the registration of the respective electrical contacts. The PCMCIA card connector also includes a card release or ejector mechanism in order to remove the PCMCIA card from the connector. In general, the release mechanism is manually actuated through a button usually located on one side of the frame. Pushing the button inwardly thus ejects the PCMCIA card through the release mechanism.

Any more, it is desirable to have several PCMCIA cards accessible to the computer at any given time. To this end, such card connectors are stacked or superposed and then mounted to a chassis or printed circuit board (PCB). This piggyback mounting conserves space. Currently, the PCMCIA card connectors are stacked in pairs, and are known as double-deck card connectors or headers. The double-deck card connector naturally includes two card ejection mechanisms to remove the two cards from the respective connector. The card ejection mechanisms have an eject or ejection button that is used to manually actuate the ejection mechanism. The prior art card connectors have their two eject buttons located either on the same or opposite sides of the connector.

However, in the case where the eject buttons are on opposite sides of the double-deck connector, the connector takes up more physical space. On the other hand, when the eject buttons are located on the same side, there is a limitation on the size of the buttons. Regardless of the end design, ejection of a card is difficult with the prior art designs. Furthermore, accidental ejection of the wrong card may occur in prior art connectors causing consumer frustration.

U.S. Pat. No. 5,197,894 entitled "Electrical Connector Equipped With A Release Mechanism" issued to Koike on Mar. 30, 1993, discloses a double-deck IC card connector/header having an ejection mechanism actuated by a single eject actuation button. The eject actuation button is located at one side of the connector/header. However, this single eject actuation button sequentially ejects the two cards depending on how far the eject actuation button is depressed. Additionally, the sequence of card ejection is predetermined by the design such that there is a first and second card ejection order. Thus, one would have to eject both cards in order to eject the second card. Also, the accidental ejection of the second card may occur if the eject actuation button is depressed too far when trying to eject the first card.

Thus, with the '894 patent, if the ejection of the second card in the sequential order is desired, the first card in the sequential order must be ejected before the ejection of the second card. The first card must therefore be reinserted into the connector in addition to the second card.

Accordingly, it is an object of the present invention to provide a card connector that has a single button or mechanism for the selective ejection of either one of both cards in a double-deck card connector.

It is another object of the present invention to provide a larger, more user friendly single button or mechanism for the selective ejection of either one of both cards in a double-deck card connector.

It is a further object of the present invention to provide a single button or mechanism for the selective ejection of either one of the two cards while preventing ejection of the non-selected card during actuation of the button in a double-deck card connector.

It is yet another object of the present invention to provide a PCMCIA card connector/header that has a single ejection button or actuation mechanism for both the upper and lower cards that is positionable to selectively eject the upper or lower card and which further includes a selection lockout mechanism to prevent accidental ejection of the non-selected card.

It is still another object of the present invention to provide a PCMCIA card connector/header as above that is biased into its initial position once selection and ejection of the desired card is achieved.

SUMMARY OF THE INVENTION

The present invention is an ejection mechanism for an electrical connector, especially a double-deck PCMCIA card connector or header. The ejection mechanism includes a single ejection button for the selection and manual ejection of the received, mating connector or device.

The eject button is biased into a first position wherein one of the two mating devices is selected for ejection. Manual repositioning of the eject button selects the second of the two mating devices for ejection. Additionally, an ejection lockout feature prohibits the ejection of the non-selected mating device regardless of the extent of button depression.

In one form thereof, the present invention is a double-deck PCMCIA card header or connector that has a single card ejection button which is manually positionable to select and eject only one of the desired two cards. The ejection/selection button engages a push-rod operably coupled to the ejection mechanism for the selected card in order to disengage the card from a plurality of electrical contacts associated with the header. Thereafter, the selected and ejected card may be removed from the header slot.

According to one aspect of the present invention, the ejection/selection button is normally biased into an initial position wherein, according to the predetermined design, either the upper or lower card is selected for ejection. Selection of the other of the upper or lower card is accomplished by manually shifting the position of the ejection/selection button before depressing the same. After selection and ejection of the desired card, the ejection/selection button returns to its initial or normal position. Additionally, the ejection/selection button includes a lockout mechanism to prevent the accidental ejection of the non-selected card during the ejection process. In this manner, only the selected card will be ejected from the header.

In a preferred embodiment, the double-deck PCMCIA card header includes a piggyback dual frame coupled to and extending from an electrical connection header. The connection header retains a plurality of electrical leads positioned to correspondingly engage the electrical sockets of the PCMCIA cards. Each frame includes oppositely disposed slots in which the sides of the PCMCIA card are received and guided. At the connection header end, each frame further has an ejection arm and associated ejection plate. The ejection arm is pivotally attached to the frame and an ejection push rod such that the ejection arm is actuated by a single side mounted ejection/selection button and shaft. Actuation of the ejection/selection rod via the ejection/selection button and shaft causes the removal of the mating device from the frame.

The single ejection/selection button is normally biased via a spring such that one of the upper or lower cards is normally selected upon depressing the button. The ejection of the other card is accomplished by manually overriding the bias and depressing the button.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION

Figure 1:
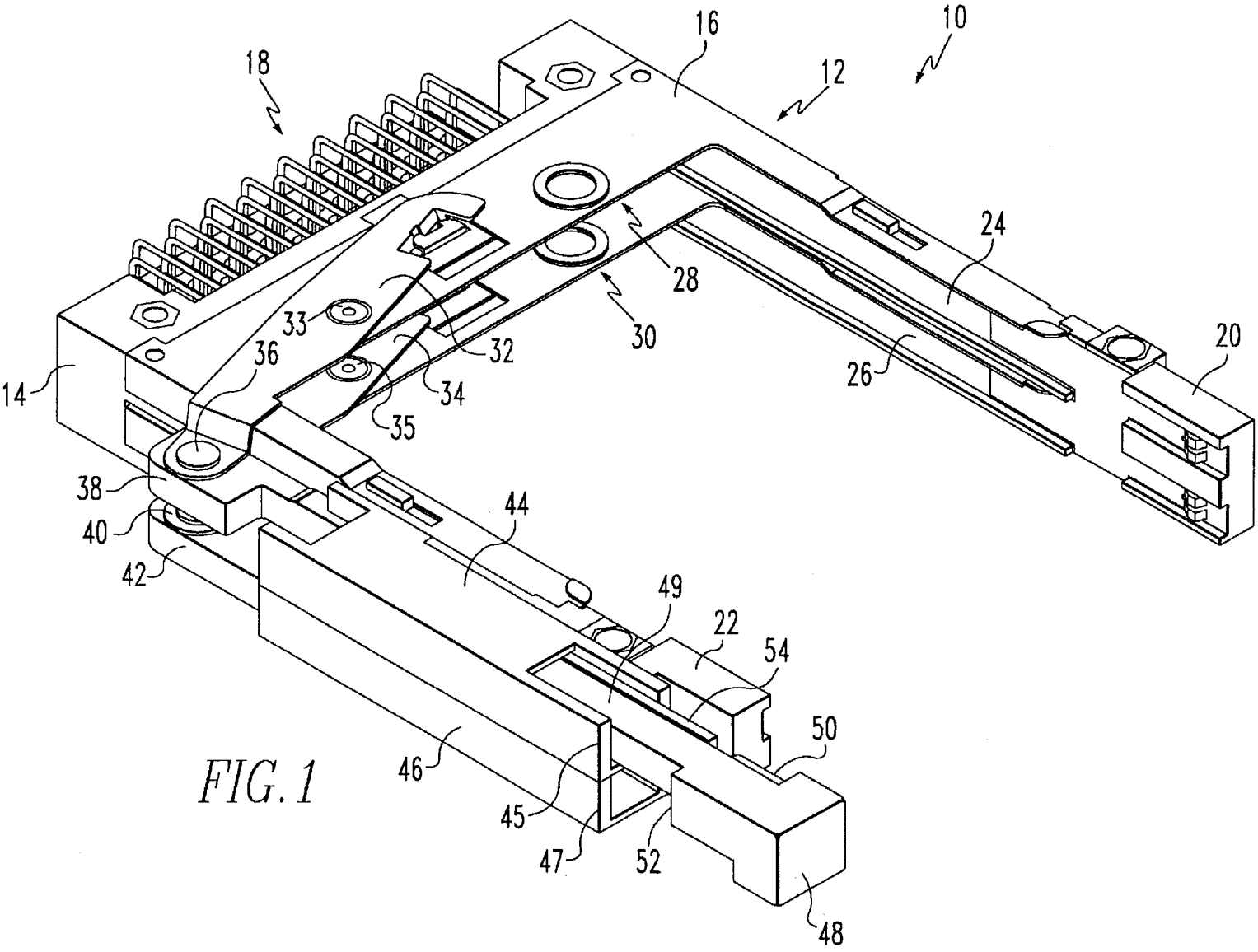
FIG. 1 is a perspective view of a double-deck PCMCIA card connector/header incorporating the present ejection mechanism.
Figure 2:
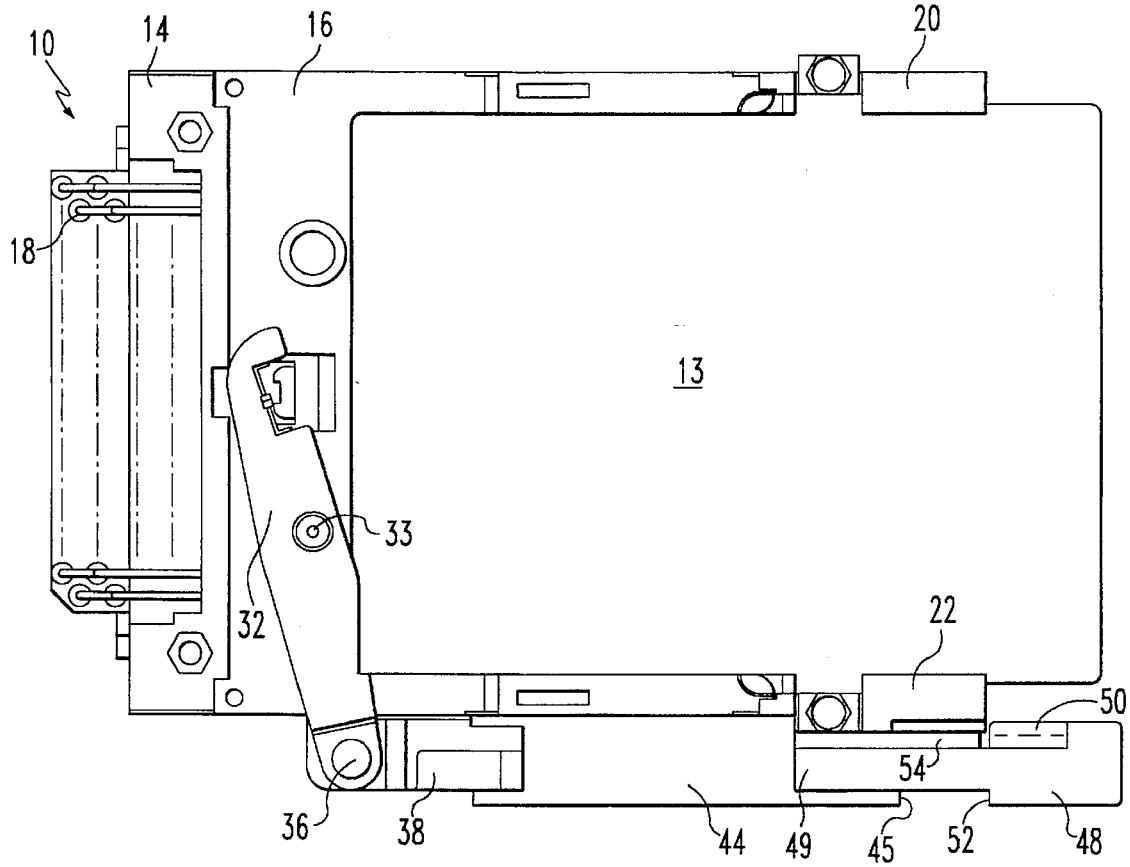
FIG. 2 is a top plan view of the double-deck PCMCIA card header with a card in the upper slot.

With reference to FIGS. 1 and 2, there is shown a double-deck PCMCIA card connector generally designated 10. The connector 10 includes a frame, generally designated 12, formed of a header portion 14 and an extension portion 16. Preferably, the header portion 14 is plastic, while the extension portion 16 is metal, such as aluminum. As best discerned in FIGS. 3 and 6, the header portion 14 includes a flat flange portion 19 through which is situated a plurality of electrical leads 18. The lower ends of the electrical leads 18 (solder ends), below the flange 19, are adapted to be soldered or connected to a printed circuit board or the like (not shown). In the manner described below, the other ends of the electrical leads 18 emerge from the header transverse to the solder ends and are received in openings in the particular card that is inserted into the connector 10.

Extending from the right side of the header 14 (as viewed in FIG. 1) is a transverse right side arm 20, while extending from the left side of the header 14 is a transverse left side arm 22. The right and left side arms 20, 22 are thus oppositely disposed and complementary to each other. The right side arm 20 defines an upper slot 24 and a lower slot 26, while the left side arm 22 likewise defines a complementary upper slot and a complementary lower slot that are not discernable in the Figures. Furthermore, the extension portion 16 defines an upper header slot 28 and a lower header slot 30. Together, the right side arm upper slot 24, the left side arm upper slot (not shown), and the upper header slot 28 forms an insertion guide and holder for an upper PCMCIA card. One such PCMCIA card 13 is shown in FIG. 2 inserted into the upper or top insertion guide. Likewise, the right side arm lower slot 26, the left side arm lower slot (not shown), and the lower header slot 30 forms an insertion guide and holder for a lower PCMCIA card (not shown).

Figure 8:
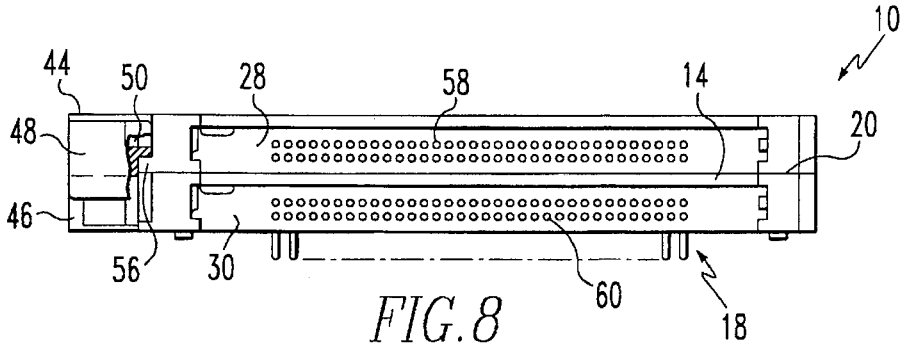
FIG. 8 is a front view of the double-deck PCMCIA eject header with the card eject selection button in the upper position.
Figure 5:
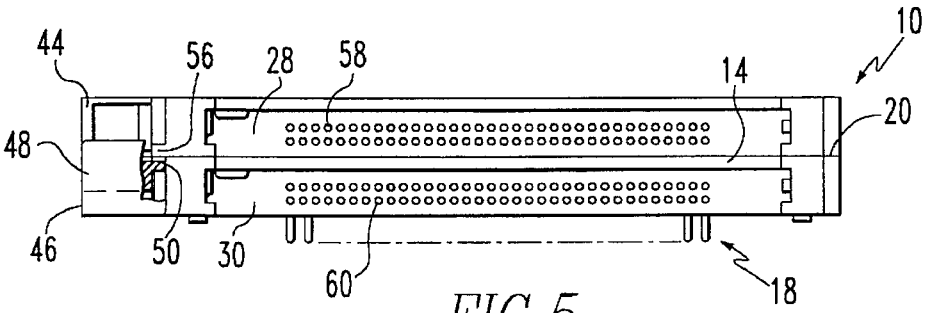
FIG. 5 is a front view of the double-deck PCMCIA eject header with the card eject selection button in the lower position.

The PCMCIA card is of a known configuration, being generally a flat plastic case having internal electrical circuitry for particular applications. The card case also includes a plurality of openings or receptacles at one end thereof that correspond in number and configuration with the plurality of electrical leads 18. The openings or receptacles permit the electrical leads 18 to be in electrical communication with the internal electrical circuitry of the PCMCIA card. As best seen in FIGS. 5 and 8, the plurality of electrical leads 18 extend into and terminate within the upper and lower header slots 28, 30 such that the electrical leads 18 are divided into two sets of pairs or rows of leads, an upper pair of leads 58 and a lower pair of leads 60. The upper pair of electrical leads 58 registers with the receptacles of the upper card while the lower pair of electrical leads 60 registers with the receptacles of the lower card.

The connector 10 also includes an upper eject arm 32 pivotally coupled at 33 to the header extension portion 16 so as to be operably associated with the upper header slot 28.

Such an eject arm is well known in the art of PCMCIA eject connectors/headers such as the present connector 10. The opposite end of the upper eject arm 32 is coupled at 36 to an upper eject rod 38 such that linear movement of the upper eject rod 38 causes the upper eject arm 32 to pivot about pivot point 33. Depending on the direction of linear movement of the upper eject rod 38, the upper eject arm 32 either ejects the upper card, or receives the upper card. Specifically, and referring to FIGS. 1 and 2, the upper eject arm 32 is shown in the card receipt position wherein the associated eject rod 38 is fully forward or towards the front of the connector 10. This would be the position of the upper eject arm 32 after a PCMCIA card has been inserted into the upper card holder of the connector 10.

The connector 10 further includes a lower eject arm 34 pivotally coupled at 35 to the header extension portion 16 so as to be operably associated with the lower header slot 30. Again, such an eject arm is well known in the art of PCMCIA eject connectors/headers such as the present connector 10. The opposite end of the lower eject arm 34 is coupled at 40 to a lower eject rod 42 such that linear movement of the lower eject rod 42 causes the lower eject arm 34 to pivot about pivot point 35. Depending on the direction of linear movement of the lower eject rod 42, the lower eject arm 34 either ejects the lower card, or receives the lower card. Specifically, and referring to FIGS. 1 and 2, the lower eject arm 34 is shown in the card receipt position wherein the associated eject rod 42 is fully forward or towards the front of the connector 10. This would be the position of the lower eject arm 34 after a PCMCIA card has been inserted into the lower card holder of the connector 10.

The upper eject rod 38 extends through an upper guide 44 and terminates at 54 proximate to an ejection button portion 48 of an ejection shaft 49. Likewise, the lower eject rod 42 extends through a lower guide 46. In accordance with an aspect of the present invention, the connector 10 has a single card selection and ejection button 48 and associated shaft 49 that is used to select and eject both the upper card and the lower card, but only one card at a time. Thus, the single card selection and ejection button 48 allows one to select either the upper card or the lower card for ejection.

Figure 3:
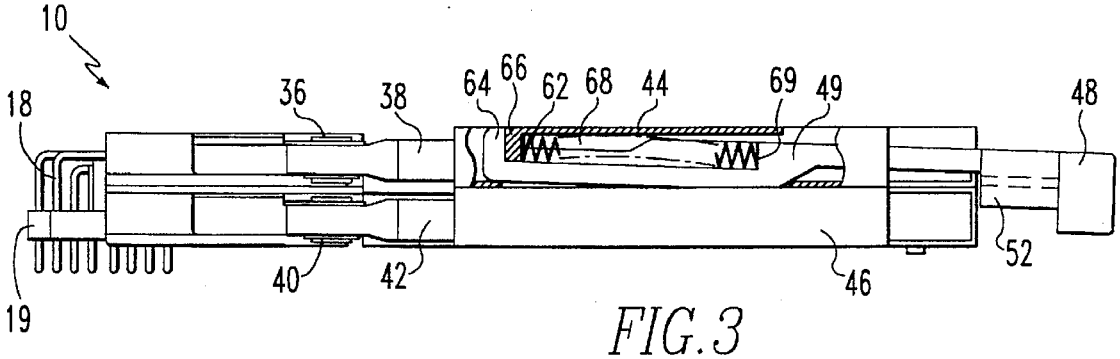
FIG. 3 is a left side view relative to FIG. 1, of the double-deck PCMCIA eject header in partial cutaway showing the card eject selection button mechanism, with the card eject selection button in the lower position.

Referring to FIG. 3, the ejection shaft 49 extends through the upper guide 44 along with the upper ejection rod 38. The ejection shaft 49 has an elongated cutout portion 68 in which is disposed a spring 62. Obviously, other biasing devices may be utilized. One end of the spring 62 abuts an end 69 defined by the elongated cutout portion 68 while the other end of the spring 62 abuts a downward directed flange or corner 66 formed or disposed inside of the upper guide 44. In accordance with another aspect of the present invention, the spring 62 serves to normally bias the ejection shaft 49 outwardly. An upward directed flange 64, complementary to the downward directed flange 66, is disposed at the end of the ejection shaft 49 and functions as a stop for the ejection shaft 49. As the spring 62 linearly outwardly biases the ejection shaft 49, the flange 64 contacts the flange 66 to limit the linear outward travel of the ejection shaft 49. Furthermore, the spring 62 naturally positions the ejection button 48 in a slightly downward position as depicted in FIG. 3. In this position, the ejection button 48 and shaft 49 are ready to eject the lower card via linear movement of the lower eject rod 42. It should be understood, however, that the present card selection and ejection mechanism may be normally biased into an upward position such that the upper card is ready for ejection via linear movement of the upper eject rod 38.

Figure 4:
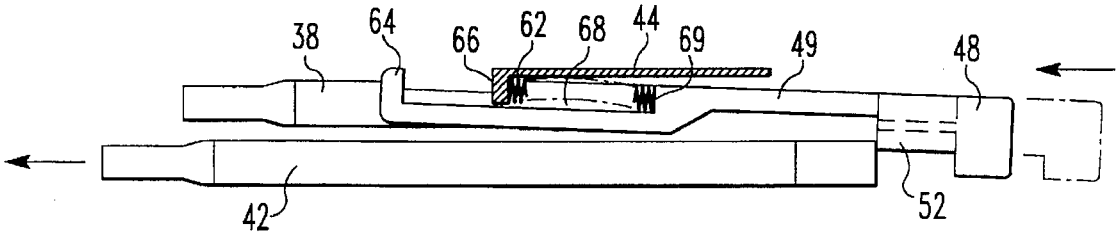
FIG. 4 is a left side view like FIG. 3 of only the card eject selection button and associated push-rods for the eject mechanism, with the lower push-rod in the eject position.

With reference now to FIGS. 3–5, the selection and ejection of the lower PCMCIA card will be detailed. As indicated above, the ejection button 48 is naturally or initially positioned to eject the lower card from the connector 10. Linear movement of the ejection shaft 49 in the direction of the arrow (FIG. 4) causes the flange 52 of the ejection button 48 to contact the rear of the lower ejection rod 42 and linearly push the lower ejection rod 42. This linear movement of the lower ejection rod 42 causes the attached lower eject arm 34 to pivot about its pivot 35 to thereby eject the lower card from the connector 10.

In a still further aspect of the present invention and specifically referring to FIG. 5, the selection and ejection mechanism includes a card selection lockout mechanism to help prevent the accidental ejection of the non-selected card. The ejection button 48 has a lockout projection 50 extending from one side thereof. Disposed essentially intermediate the upper and lower guide is a longitudinal bar 56 that coacts with the lockout projection 50 to maintain the ejection shaft 49 along its selected travel path such that the non-selected card will not be ejected. This is accomplished in the following manner. Before the ejection button 48 is depressed, the lockout flange 50 is linearly ahead of the lockout bar 56. As the ejection button 48 is depressed, the lockout flange is positioned below the lockout bar 56 which thereafter prevents the ejection button 48 and thus the ejection shaft 49 from moving upwardly to accidentally eject the upper card.

Figure 6:
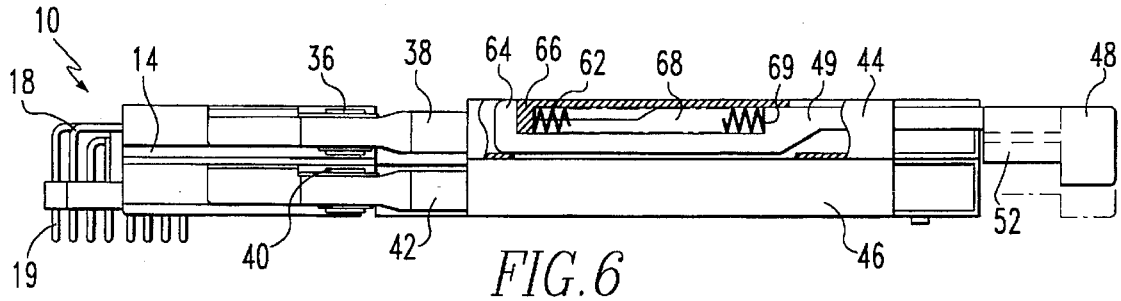
FIG. 6 is a left side view relative to FIG. 1 of the double-deck PCMCIA eject header in partial cutaway showing the card eject selection button mechanism, with the card eject selection button in the upper position, and showing the lower position of the card eject selection button in phantom.
Figure 7:
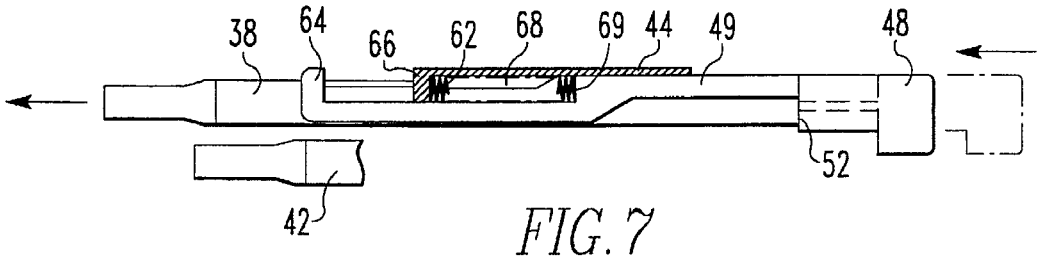
FIG. 7 is a left side view like FIG. 6 of only the card eject selection button and associated push-rods for the eject mechanism, with the upper push-rod in the eject position.

In like manner to the selection and ejection of the lower card the selection and ejection of the upper card will now be described with reference to FIGS. 6–8. Because the ejection button 48 is naturally biased to eject the lower card, it is necessary to manually push the ejection button 48 upwards as indicated in FIG. 6. This aligns the flange 52 of the ejection button 48 with the rear of the upper ejection rod 38. Linear movement of the ejection shaft 49 in the direction of the arrow (FIG. 7) causes the flange 52 of the ejection button 48 to contact the rear of the upper ejection rod 38 and linearly push the upper ejection rod 38. This linear movement of the upper ejection rod 38 causes the attached upper eject arm 32 to pivot about its pivot 33 to thereby eject the upper card from the connector 10.

Referring to FIG. 8, before the ejection button 48 is depressed, the lockout flange 50 is linearly ahead of the lockout bar 56. As the ejection button 48 is depressed, the lockout flange is positioned above the lockout bar 56 which thereafter prevents the ejection button 48 and thus the ejection shaft 49 from moving downward to accidentally eject the lower card.

While the foregoing is directed to the preferred embodiment of the present invention, other and further embodiments of the invention may be devised without departing from the basic scope thereof, and the scope thereof is determined by the claims which follow.

What is claimed is:

1. An electrical connector for releasably retaining a first and second mating element, the connector comprising:

a frame, said frame having an upper slot and a lower slot for respective receipt of the first and second mating elements;

a plurality of upper electrical contacts extending through one end of said frame and terminating within said upper slot, the first mating element matingly engaging said plurality of upper electrical contacts when fully inserted into said upper slot;

a plurality of lower electrical contacts extending through said one end of said frame and terminating within said lower slot, the second mating element matingly engaging said plurality of lower electrical contacts when fully inserted into said lower slot;

a first release mechanism associated with said upper slot and adapted to release the first mating element from mating engagement with said plurality of upper electrical contacts upon actuation;

a second release mechanism associated with said lower slot and adapted to release the second mating element from mating engagement with said plurality of lower electrical contacts upon actuation; and a single release button selectively positionable to actuate either one of said first and second release mechanisms.

2. The electrical connector of claim 1 wherein said release button includes a lockout mechanism to prevent actuation of the non-selected one of said first and second release mechanisms and thus the release of the respective first or second mating element therefrom.

3. The electrical connector of claim 1, wherein said release button is normally biased such that one of said first or second release mechanisms is initially selected.

4. The electrical connector of claim 1, wherein said first release mechanism includes a first push rod adapted to be contacted by said release button upon selection of said first release mechanism through positioning of said release button, and said second release mechanism includes a second push rod adapted to be contacted by said release button upon selection of said second release mechanism through positioning of said release button, said first and second push rods disposed adjacent one another and on one side of said frame, said release button disposed on said one side.

5. A double-deck card header for engaging and holding upper and lower cards, the double-deck card header comprising:

a frame having a closed end and first and second opposite sides extending transverse to said closed end, said closed end and said first and second sides defining an open end opposite said closed end;

an upper slot defined in part by first and second upper channels formed in said first and second sides respectively, said upper slot adapted to receive the upper card;

a lower slot defined in part by first and second lower channels formed in said first and second sides respectively, said lower slot adapted to receive the lower card;

a first plurality of electrical contacts extending through said closed end and terminating in said upper slot, the upper card matingly engaging said first plurality of electrical contacts when fully inserted into said upper slot;

a second plurality of electrical contacts extending through said closed end and terminating in said lower slot, the lower card matingly engaging said second plurality of electrical contacts when fully inserted into said upper slot;

an upper eject mechanism operable upon actuation to remove the upper card from mating engagement with said first plurality of electrical contacts, said upper eject mechanism including an upper push rod coupled to an upper eject arm which, upon depressing, actuates said upper eject arm to disengage the upper card, said upper push rod disposed on said first side of said frame;

a lower eject mechanism operable upon actuation to remove the lower card from mating engagement with said second plurality of electrical contacts, said lower eject mechanism including a lower push rod coupled to a lower eject arm which, upon depressing, actuates said lower eject arm to disengage the lower card, said lower push rod disposed on said first side of said frame adjacent said upper push rod; and a card eject button positionable to select and engage either one of said upper or lower push rods to actuate the respective upper and lower eject mechanisms.

6. The double-deck card header of claim 5, wherein said card eject button is normally biased into an initial position whereby one of said upper and lower push rods are selected.

7. The double-deck card header of claim 6, wherein said card eject button is spring biased into said initial position.

8. The double-deck card header of claim 5 wherein said card eject button includes an eject lock-out that prevents actuation of the non-selected upper or lower eject mechanism upon actuation of the other selected upper or lower eject mechanism.

9. The double-deck card header of claim 8, wherein said eject lock-out comprises a flange on said card eject button that contacts one end of said push rods and is constrained by a ledge disposed between said upper and lower push-rods.

10. The double-deck card header of claim 9, wherein said card eject button is an elongated bar disposed adjacent said upper and lower push rods and including a retaining portion that holds one end of a spring, said spring retained at another end by said frame to normally bias said card eject button into an initial position whereby said upper and lower push rods are unselected for actuation.

11. The double-deck card header of claim 5, wherein said card eject button is positionable in an up position and a down position, said up position selecting said upper push rod for actuation of said upper release mechanism, said down position selecting said lower push rod for actuation of said lower release mechanism.

12. A double-deck PCMCIA card header for releasably engaging an upper card and a lower card, the card header comprising:

a frame having a closed end, an open end, and left and right transverse side walls, said left transverse side wall having a top longitudinal groove and a bottom longitudinal groove, said right transverse side wall having a top longitudinal groove opposite said top longitudinal groove of said left transverse side wall and a bottom longitudinal groove opposite said bottom longitudinal groove of said left transverse side wall, said top longitudinal grooves defining an upper card slot, and said bottom longitudinal grooves defining a lower card slot;

a first plurality of electrical contacts extending through said closed end and into said upper slot;

a second plurality of electrical contacts extending through said closed end and into said lower slot;

an upper card ejection mechanism adapted to release the inserted upper card from mating engagement with said first plurality of electrical contacts, said upper card ejection mechanism including an upper push rod disposed in an upper guide and coupled at one end to a pivoting upper lever arm, wherein actuation of said upper push rod causes said upper lever arm to release the upper card;

a lower card ejection mechanism adapted to release the inserted lower card from mating engagement with said second plurality of electrical contacts, said lower card ejection mechanism including a lower push rod disposed in a lower guide and coupled at one end to a pivoting lower lever arm, wherein actuation of said lower push rod causes said lower lever arm to release the lower card; and a card ejection actuation button operably coupled to said frame and positionable to select and engage either one of said upper and lower push rods at another end thereof in order to actuate the respective upper and lower card ejection mechanisms.

13. The card header of claim 12, wherein said card ejection actuation button includes a flange on one end thereof that engages one end of the selected one of said upper and lower push rods once said card ejection actuation button is depressed to actuate said selected upper or lower push rod.

14. The card header of claim 12, wherein said card ejection actuation button is an elongated member disposed adjacent said upper and lower push rods, and includes a retaining portion on one end that holds one end of a spring, said spring held at another end by said frame to normally bias said card ejection actuation button into an initial position wherein said upper and lower push rods are unselected for actuation, and a flange that is adapted to contact one end of said push rods and is constrained by a ledge disposed between said upper and lower push rods to provide an eject lock-out that prevents actuation of the non-selected upper or lower card ejection mechanism.

15. The card header of claim 12, wherein said card ejection actuation button is selectively positionable in a first position and a second position, said first position selecting said upper push rod for actuation of said upper card ejection mechanism, said second position selecting said lower push rod for actuation of said lower card ejection mechanism.

16. The card header of claim 15, wherein said card ejection actuation button is normally biased in an initial position before manual selection whereby one of said upper and lower card ejection mechanisms is selected.

* * * * *